United States Patent [19]

Sommer

[11] 3,966,578

[45] June 29, 1976

[54] METHOD OF MAKING THIN FILM THERMISTOR

[75] Inventor: Alfred Sommer, Teaneck, N.J.

[73] Assignee: Ceramic Magnetics, Inc., Fairfield, N.J.

[22] Filed: Aug. 1, 1974

[21] Appl. No.: 493,906

Related U.S. Application Data

[62] Division of Ser. No. 434,067, Jan. 17, 1974, Pat. No. 3,851,291.

[52] U.S. Cl. ..... 204/192; 252/512; 252/518

[51] Int. Cl.[2] ..... C23C 15/00; H01B 1/02

[58] Field of Search ..... 204/192; 29/612; 338/22 R; 252/512, 518

[56] References Cited

UNITED STATES PATENTS

| | | | |
|---|---|---|---|
| 3,140,531 | 7/1964 | Vanik et al. | 29/612 |
| 3,452,314 | 6/1969 | Sapoff et al. | 29/612 X |
| 3,748,174 | 7/1973 | Chen et al. | 29/612 X |
| 3,831,269 | 8/1974 | Sommer | 29/612 |

*Primary Examiner*—T. Tung
*Assistant Examiner*—Aaron Weisstuch
*Attorney, Agent, or Firm*—Kenyon & Kenyon Reilly Carr & Chapin

[57] ABSTRACT

A thin film thermistor and a method of making such a thermistor in which a composition of lead telluride plus 5% cerium is sputtered on to a polyimide film after which electrodes are deposited thereon with the width of lead telluride composition remaining uncovered being controlled to thereby control the thermistor characteristics.

6 Claims, 5 Drawing Figures

METHOD OF MAKING THIN FILM THERMISTOR

This is a division of application Ser. No. 434,067, filed Jan. 17, 1974, now U.S. Pat. No. 3,851,291.

BACKGROUND OF THE INVENTION

Thermistors which are a resistor type device whose electrical resistivity varies significantly with absolute temperature have found various uses as temperature sensing and temperature measuring devices. Typically prior art thermistors have been formed in the shapes of beads using a ceramic process which requires batch mixing, processing sintering and a great many other processes to obtain a finished product. Some thin film thermistors have been made but these have generally been manufactured using similar processes. Because of all these process steps and the variables associated therewith the characteristics and accuracy of such thermistors is difficult to maintain. In addition thermistors made through these processes tend to be noisy and because of their relatively large mass and the heavy electrodes which are later attached thereto respond rather slowly to temperature changes and have a limited sensitivity. Although relatively small, their size with respect to many present day microcircuits is considered large making it difficult to integrate them with these other circuits. Thus they can only be used as discrete component circuits.

In various applications such as in weather balloons and the like there is a need for a type of thermistor which is extremely light, flexible, and which responds to temperature changes rapidly. Such a thermistor should also be capable of being easily integrated with other circuits. In addition it is desirable that the thermistor be capable of being made to close tolerances and to have characteristics which do not vary from thermistor to thermistor. It is also desirable in thermistors of this type to be able to accurately control the thermistors' characteristics in a simple manner.

SUMMARY OF THE INVENTION

The present invention provides a thermistor which meets these various needs. The thermistor is a thin film thermistor which is deposited on a thin polyimide film. The polyimide film is placed in a sputtering chamber and a mask placed over it whereupon it is sputtered with a composition of lead teleuride plus approximately 5% cerium. Upon deposit of the thermistor material onto the polymide substrate the substrate is then placed in a vacuum deposition chamber wherein electrodes, preferably of gold, are deposited on to the substrate to form electrical contacts for the thermistor. Because of the small size of the thermistors it is possible in these above described steps to produce a plurality of thermistors during one operation. By controlling the size of the thermistor material, i.e. the lead teleuride compound, which remains uncovered after depositing the electrodes the temperature characteristics of the thermistor are controlled. In one disclosed method the masking of the deposited thermistor material is accomplished through the use of a thin wire, with different gauge wires being used to obtain different thermistor characteristics.

The resulting thermistor is extremely light and flexible and, because it does not have neavy substrate or ceramic materials nor typical heavy leads, is extremely sensitive to temperature change responding very quickly.

DETAILED DESCRIPTION OF THE PREFERRED EMBODIMENT

Figure 1:
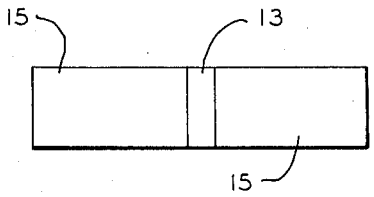
FIG. 1 is a plan view of a thermistor made according to the present invention.
Figure 2:
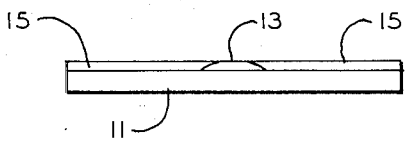
FIG. 2 is an elevation view of the thermistor of FIG. 1.
Figure 3:
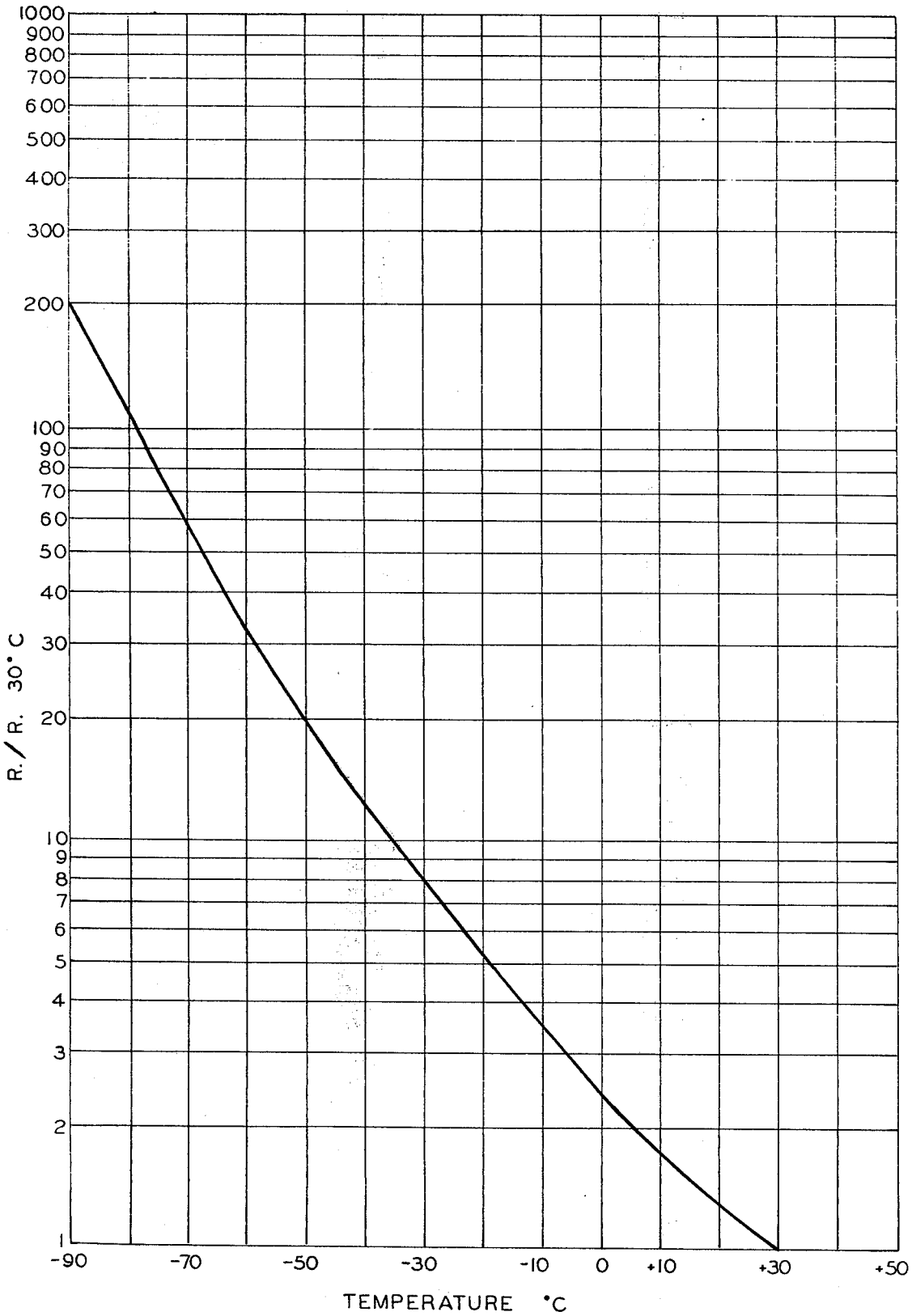
FIG. 3 is a temperature characteristic curve for a thermistor made according to the present invention.

FIG. 1 illustrates a plan view of a thermistor made according to the present invention. The thermistor comprises a polyimide film 11 such as DuPont Kapton Film upon which is deposited, (on its center section), in a manner to be described below, a thermistor material 13. After deposit of the thermistor material 13 on the film there are then deposited electrodes 15 which will preferably be of gold although other metals may also be used. As will be seen from below, a plurality of thermistors such as those shown on FIGS. 1 and 2 may be processed at one time. Therefore the final step of making the thermistor will comprise cutting it to the shape shown on the Figures. The preferred thermistor material 13 is a mixture of lead teleuride plus 5% cerium. The characteristic of a thermistor made using this material is illustrated on FIG. 3. On this Figure temperature in degrees centigrade is plotted against the ratio of the resistance of the thermistor at 30°C. to that at a specified temperature. As shown the resistance changes by a factor of 200 over the range of −90° to +30°C. This makes the thermistor very sensitive to temperature changes and allows it to measure small differences in temperature. By using very thin polyimide film as the substrate material, the thermistor has a very low mass enabling it to respond much more rapidly to temperature changes than can prior art thermistors. This is particularly useful in applications where rapid temperature changes are encountered. In addition this construction results in a very small difference between the sensor temperature and ambient temperature no matter how quickly ambient temperature is changing.

Figure 4:
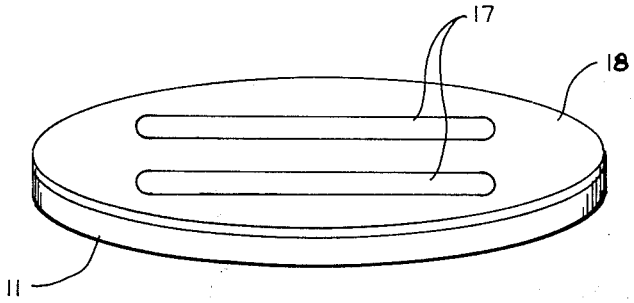
FIG. 4 is a perspective view illustrating a typical type of mask which may be used when sputtering the thermistor material on to the substrate.

The composition of lead teleuride plus approximately 5% cerium is deposited on the thin polyimide film in a RF sputtering chamber (with a frequency of approximately 13 MHz) under a vacuum at a pressure of about 10 microns of an inert gas, for example, argon. As shown on FIG. 4 a stainless steel mask 18 is placed over the polyimide film 11 so that the material will be selectively deposited in two strips 17. Although strips are shown herein, the material can equally well be deposited in dots, squares etc. to form a plurality of thermistor areas on the polyimide film. Typical of the type of equipment which may be used to perform the step of sputtering is that manufactured by Varian Associates and termed the Varian RF Diode Sputtering System. Preferably, before sputtering the substrate will be scrubbed in well known fashion to remove any foreign matter and free molocules such as oxygen which may be loosely connected to the substrate.

Figure 5:
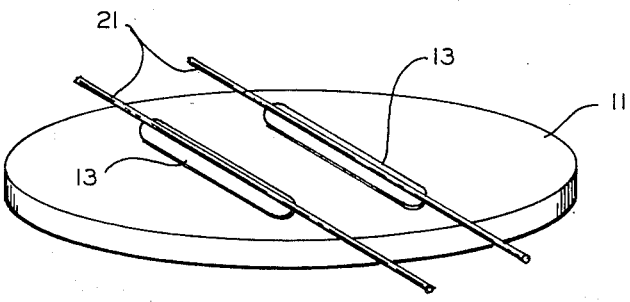
FIG. 5 is a perspective view illustrating the manner in which thin wires may be used to mask the thermistor material when depositing the gold electrodes.

After sputtering the thermistor material on to the polyimide film the material is removed and placed in a vacuum deposition chamber such as that manufactured by Varian Associates and sold under the name Innovac. Suitable masks are placed over the thermistor material 13 which if deposited in strips as shown in FIG. 5 may be thin wires 21 as shown on FIG. 5. The electrodes, which will preferably be gold, are formed by evaporation and condensation of the metal onto the film with such condensation occuring at all portions of the film 11 except those covered by the wires 21. Alternatively, deposit of electrodes may also be done by sputtering. After deposit of the electrodes, the polyimide film may then be cut up to form the individual thermistors of FIGS. 1 and 2.

In accordance with the well know equations for resistance, resistance of the thermistor will be a function of the resistivity of the material, which is predetermined by the selected thermistor material described above, times the length divided by the area. The area is made up of the thickness times the width of the thermistor material. Both of these will be essentially maintained constant. Thus by controlling the length of the thermistor material, i.e. the distance between the electrodes, its resistance may be easily controlled. To do this it is only necessary to control the mask size which in the example shown above means controlling the diameter or gauge of the wires 21. Typically the thermistor material 13 will be deposited to a thickness of 0.001 in. by sputtering for 1 hour. A typical width of a finished thermistor is 0.15 in. Resistance may be determined by the following:

$$R = P \frac{L}{A}$$

where

A = W × H
W = width
H = thickness
L = length and
P = resistivity.

A typical resistivity is 1500 Ωcm at 30°C. Then, for example, if a thermistor having a resistance of 100 k is desired:

$$R = 100\ K \qquad W = .15'' \qquad H = .001''$$

$$1500 = \frac{100 \times 10^3 \times .150 \times .001 \times 2.54}{L}$$

$$L = .00254''$$

Thus, to form such a thermistor, a length of 0.00254 inch is masked when depositing the electrode.

The target material, i.e., the lead teleuride plus cerium used in the sputtering chamber may be prepared in conventional fashion through hot processing techniques. Although this composition was found to be particularly good, other compositions well known in the thermistor art may be equally well used. The manner of construction of the thermistor device lends it to integration into integrated circuits without much difficulty.

Thus, an improved thermistor which is extremely lightweight and responds quickly to temperature changes and which may be easily manufactured using well known sputtering techniques has been shown. Although specific embodiments have been illustrated and described, it will be obvious to those skilled in the art that various modifications may be made without departing from the spirit of the invention which is intended to be limited solely by the appended claims.

I claim:

1. The method of forming a thin film thermistor comprising the steps of:

a. preparing a substrate of thin polyimide film;
b. placing a mask over said film to define areas upon which thermistor material is to be deposited;
c. placing said film and said mask in a sputtering chamber and sputtering a thermistor material consisting of lead teleuride plus approximately 5% cerium on to said thin film; and
d. depositing metal electrodes on said film to provide electrical contact to the thermistor material deposited thereon.

2. The invention according to claim 1 wherein a plurality of thermistors are to be made and further including the step of cutting said thin film into individual thermistors after deposition of said electrodes.

3. The invention according to claim 1 wherein said electrodes are gold.

4. The invention according to claim 1 wherein said electrodes are deposited by vacuum deposition performed in a vacuum chamber and wherein the portion of the thermistor material to be left uncovered by electrodes is masked.

5. The invention according to claim 1 wherein the thermistor material is deposited as a plurality of strips and wherein said masking of thermistor material is done by placing thin wires over the center of said strip.

6. The invention according to claim 5 and further including the step of controlling the resistance of said thermistor by controlling the gap between the two electrodes deposited on said substrate on each side of said thermistor material.

* * * * *